US006236193B1

(12) United States Patent
Paul

(10) Patent No.: US 6,236,193 B1
(45) Date of Patent: May 22, 2001

(54) APPARATUS FOR VOLTAGE REGULATION AND RECOVERY OF SIGNAL TERMINATION ENERGY

(75) Inventor: Harry V. Paul, Haddonfield, NJ (US)

(73) Assignee: Inrange Technologies Corporation, Lumberton, NJ (US)

( * ) Notice: Subject to any disclaimer, the term of this patent is extended or adjusted under 35 U.S.C. 154(b) by 0 days.

(21) Appl. No.: 09/587,952

(22) Filed: Jun. 6, 2000

Related U.S. Application Data

(60) Provisional application No. 60/158,420, filed on Oct. 7, 1999.

(51) Int. Cl.[7] ..... G05F 1/40; G05F 1/56
(52) U.S. Cl. ..... 323/268; 323/282
(58) Field of Search ..... 323/282, 265, 323/266, 267, 268, 271

(56) References Cited

U.S. PATENT DOCUMENTS

| | | | | |
|---|---|---|---|---|
| 4,661,747 | | 4/1987 | Gray, Sr. | 315/330 |
| 5,396,527 | | 3/1995 | Schlecht et al. | 377/57 |
| 5,412,308 | * | 5/1995 | Brown | 323/267 |
| 5,430,399 | | 7/1995 | Wendell | 326/121 |
| 5,550,729 | * | 8/1996 | Wissell | 363/65 |
| 5,592,072 | * | 1/1997 | Brown | 323/268 |
| 5,691,630 | * | 11/1997 | Chosa | 323/267 |
| 5,864,225 | * | 1/1999 | Bryson | 323/268 |
| 5,892,395 | | 4/1999 | Stengel et al. | 330/124 |
| 5,923,143 | | 7/1999 | Cosan et al. | 318/729 |
| 6,084,383 | * | 7/2000 | Borinsky et al. | 323/268 |

OTHER PUBLICATIONS

"MCS (R) 96 Microcontollers: Back to Basics: Pulse Width Modulator on the 8XC196KC/KD"; *www.mmx.com/design/mcs96/technote/2383.htm*, 4 pp., 1999 Intel Corporation.

"1–Cell to 3–Cell, High–Power (1.5A), Low–Noise, Step–Up DC–DC Converter"; 19–1336; Rev 2.; Maxim Integrated Products; pp. 1–16, 11/98.

"High Current, Micropower Single Cell, 600kHz DC/DC Converters"; Linear Technology; *www.linear.com/cgi–bin/database?f...me=DataSheet.html&name*; Linear Technology, 2 pp. 1996, 97 Linear Technology.

* cited by examiner

*Primary Examiner*—Peter S. Wong
*Assistant Examiner*—Bao Q. Vu
(74) *Attorney, Agent, or Firm*—Hamilton, Brook, Smith & Reynolds, P.C.

(57) ABSTRACT

An apparatus for regulating the signal termination voltage planes of a system, the signal termination voltage planes having a voltage which is between, or intermediate to, the system's upper and lower power supply voltage planes, and for recovering signal termination energy, which is normally dissipated or otherwise wasted, and for transferring the recovered energy to the system's upper power supply voltage plane, or power bus, for reuse.

24 Claims, 1 Drawing Sheet

APPARATUS FOR VOLTAGE REGULATION AND RECOVERY OF SIGNAL TERMINATION ENERGY

RELATED APPLICATIONS

This application claims priority of provisional application No. 60/158,420 filed Oct. 7, 1999.

BACKGROUND OF THE INVENTION

1. Field of the Invention

The present invention relates to electrical circuits and signals, and, more particularly, to an apparatus for regulating electrical voltages and recovering energy normally lost during the termination of electrical signals to a voltage between power supply voltage planes.

2. Description of the Prior Art

Electrical signals travel between generating points and terminating points, or output points and input points. Where only the voltage component of a signal is desired at a terminating point, any inherent signal energy must be dissipated or transferred. Large synchronous systems commonly require numerous instances where clock and data buses are distributed using differential voltage pairs, as well as numerous instances where electrical signals must be terminated to a particular voltage. Such systems typically connect termination resistors to a common, regulated termination voltage plane which has a voltage between, or intermediate to, the upper and lower power supply voltage planes. The regulatory requirements for a termination voltage plane are unique in that the termination resistors become, in effect, a current source that the regulator must sink to circuit ground. Thus, such systems must simultaneously regulate voltage planes, sink current produced by termination resistors, and absorb power as well. Common commercially available regulator modules and integrated circuit regulators are not suitable for this application, being designed only to source current and deliver power to a load.

Current mode switching logic systems, including emitter-coupled logic (ECL) and positive emitter-coupled logic (PECL) systems, require strict regulation of termination voltage planes in order to maintain the voltage difference necessary to prevent the bipolar junction transistors from entering saturation. Furthermore, large high-performance ECL and PECL systems can generate a substantial amount of signal termination energy. Although ECL is the fastest logic family, it can be so wasteful of energy as to make ECL undesirable for many systems which would otherwise benefit from its speed advantage.

SUMMARY OF THE INVENTION

The present invention solves the above described problems with a novel adaptation of commercially available electrical components that alleviates the problems of voltage regulation and high energy consumption in systems involving signal terminations to an intermediate voltageplane between power supply voltage planes. More particularly, the present invention provides an apparatus for regulating termination voltage planes in fixed relation to an upper power supply voltage plane, and for recovering signal termination energy. These advantages over the prior art will make current mode switching logic systems, and ECL- and PECL-based systems in particular, more energy efficient and economically competitive and therefore a more viable alternative for systems currently employing slower logic families.

BRIEF DESCRIPTION OF THE DRAWINGS FIGURES

A preferred embodiment of the present invention is described in detail below with reference to the attached drawing figures, wherein.

DETAILED DESCRIPTION OF THE PREFERRED EMBODIMENT

Figure 1:
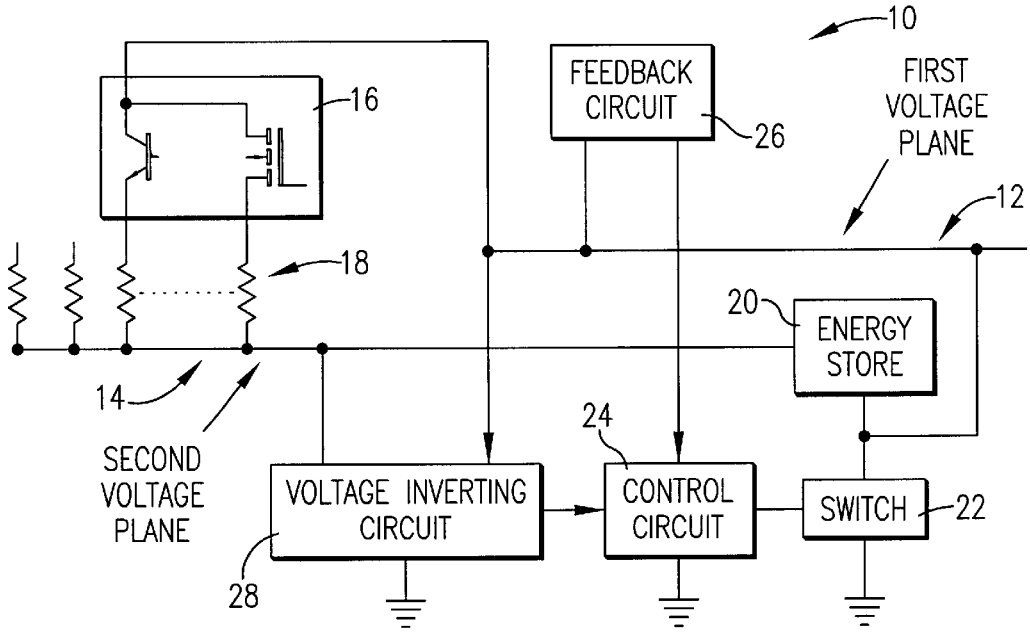
FIG. 1 is a generalized block diagram illustrating in broad terms a preferred embodiment of the present invention's major components and their relative functions.

Referring first to FIG. 1, a system 10 is shown comprising a first voltage plane 12 having a higher voltage than a second voltage plane 14. The system may be electrical in nature and may include fiberoptic or magnetic components; however, the present invention has application in any system that can benefit from the regulation of termination voltage planes and from recovering signal termination energy, without regard to the broad nature of the system or its components.

In the preferred embodiment, involving ECL devices, the first voltage plane is a $V_{cc}$ logic power supply voltage plane operating at +5 volts and the second voltage plane is a $V_{tt}$ termination voltage plane operating at +3 volts. Where this two volt relative difference can be maintained, bipolar junction transistors avoid saturation and can switch very fast, thereby making ECL and PECL the fastest family of logic devices. Typical device output structures 16 are shown connected at one end to the first voltage plane 12 and at the other end to one or more signal termination resistors 18. In the preferred embodiment, typical device output structures 16 would include open emitter or open drain structures sourcing current from the first voltage plane 12, with the sourced current depending upon the logic state. The signal termination resistors 18 are, in turn, connected to the second voltage plane 14. When an electrical signal, originating at an output point, arrives at an input point, the energy of that signal must be either dissipated or transferred so as to have no adverse electrical effect upon the receiving device. Typically, this signal energy would be dissipated as heat or otherwise wasted. In the present invention, however, this signal energy is recovered, stored, and subsequently returned to the system's first voltage plane 12 while regulating the second voltage plane 14.

An energy store 20 allows the present invention to store signal termination energy for subsequent use. In the preferred embodiment, the energy store 20 is an inductor. A mechanism for transferring the stored signal termination energy comprises a switch 22 and a control circuit 24, with the control circuit 24 being operable to accept a plurality of input signals and to produce a desired output signal. In the preferred embodiment, the switch 22 may be internal to the control circuit 24 and comprises a diode and a metal oxide semiconductor transistor, and the control circuit 24 is a pulse width modulator capable of producing a high signal, a low signal, and a variable duty cycle. A feedback circuit 26 controls the output signal of the control circuit 24 which controls the switch 22 which controls the timing and amount of any energy released from the energy store 20. In the preferred embodiment, the feedback circuit 26 comprises a common voltage divider circuit constructed entirely of resistors.

The typical open loop transfer function of the control circuit 24 is such that a decrease in voltage on the feedback pin results in an increase in energy transferred from the energy store 20. Thus, a decrease in feedback voltage from the feedback circuit 26 causes the control circuit 24 to produce a signal which closes the switch 22 and allows stored energy to be transferred from the energy store 20 to the first voltage plane 12.

In order to regulate the second voltage plane 14, the circuit must exhibit an open loop transfer function such that an increase in the voltage of the second voltage plane 14 results in an increase in energy transferred from the second voltage plane 14 to the first voltage plane 12. Thus, the circuit must sink current flowing into the second voltage plane 14 as a result of resistive signal termination, and transfer the resulting energy to the first voltage plane 12. The voltage inverting circuit 28 of FIG. 1 adapts the transfer function of the control circuit 24 to meet these requirements by providing a change in feedback voltage which is the opposite of any change in the voltage of the second voltage plane 14. In addition, the voltage inverting circuit 28 provides the necessary level shift so that the voltage of the second voltage plane 12 is maintained when the feedback voltage is equal to the reference voltage of the control circuit 24. In the preferred embodiment, the voltage inverting circuit 28 is a level shifting voltage inverter.

Figure 2:
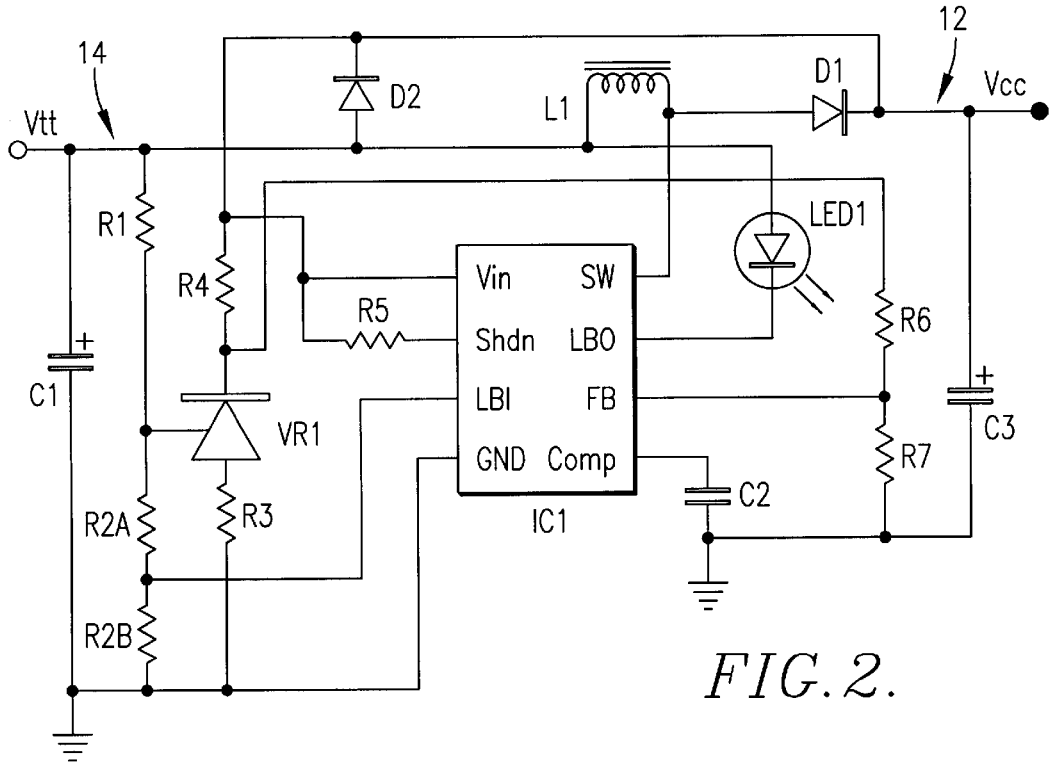
FIG. 2 is a detailed circuit schematic illustrating the design of a preferred embodiment of the present invention.

FIG. 2 is a more detailed and application specific example of the present invention, which illustrates the preferred embodiment as used in an ECL system. The control circuit 24 of FIG. 1 is represented as a pulse width modulator, IC1, in FIG. 2. Similarly, the energy store 20, switch 22, and feedback circuit 26 of FIG. 1 are represented, respectively, by an inductor L1, a diode D1 and a bipolar transistor switch internal to IC1, and a combination of resistors R4,R6,R7. Referring to FIG. 2, a diode D2 ensures that the voltage of the second voltage plane 14 will not exceed the voltage of the first voltage plane 12. When illuminated, a light-emitting diode LED1 indicates that the inventive circuit is operating properly. Regulator failures that result in the voltage of the second voltage plane 14 being too low will cause the light-emitting diode LED1 to dim or extinguish due to insufficient voltage. Regulator failures that result in the voltage of the second voltage plane 14 being too high will cause the light-emitting diode LED1 to extinguish when the voltage on an input pin of the pulse width modulator IC1 exceeds an internal threshold.

The voltage inverting circuit 28 of FIG. 1 is shown in more detail in FIG. 2, being a level shifting voltage inverter comprising a network of resistors R1,R2A, R2B, R3, R4 and a three terminal shunt regulator VR1. The three terminal shunt regulator VR1 must have the property of increasing anode and cathode current in response to a control voltage input that is greater than an internal reference voltage, and decreasing anode and cathode current in response to a control voltage input that is less than an internal reference voltage. In the preferred embodiment, the three terminal shunt regulator VR1 will regulate the current through itself to maintain a difference of +1.25 volts between its control pin and its anode terminal. With R1 equal to R2A+R2B, the control pin will be +1.5 volts when the second voltage plane 14 is regulated to +3.0 volts. Thus, the three terminal shunt regulator VR1 will cause a current in R3 that produces +0.25 volts. The current in R4 is essentially the same as the current in R3, which makes R4/R3 the ratio of voltage drops across the two resistors. An increase in the voltage of the second voltage plane 14 will cause an increase in three terminal shunt regulator VR1 current. The resulting increase in R4 current will cause a decrease in anode voltage thereby achieving the required voltage inversion for the control loop and allowing for the regulation of the second voltage plane 14. The cathode appears as a high impedance current sink, therefore an increase in the voltage of the first voltage plane 12 will cause an increase in the cathode voltage. This interaction at this node in the control loop will cause the voltage of the second voltage plane 14 to track the first voltage plane 12.

From the preceding description, it can be seen that the present invention alleviates the problems of voltage regulation and high energy consumption in systems involving signal terminations to a voltage between power supply voltage planes. More particularly, the present invention regulates the termination voltage planes of a system and recovers signal termination energy which would otherwise be wasted.

Although the invention has been described with reference to the preferred embodiment illustrated in the attached drawings, it is noted that equivalents may be employed and substitutions made herein without departing from the scope of the invention as recited in the claims. For example, although the preferred embodiment involves ECL devices and systems, the present invention has merit in any system requiring a signal termination voltage between voltage planes, or power supply rails.

Having thus described the preferred embodiment of the invention, what is claimed as new and desired to be protected by Letters Patent includes the following:

What is claimed is:

1. An apparatus for regulating the intermediate voltage planes of a system relative to an upper power supply voltage plane, the apparatus transferring energy, which is normally wasted or dissipated during the termination of an electrical signal, from an intermediate voltage plane to an upper power supply voltage plane, the apparatus comprising:

a control circuit operable to accept a plurality of input signals and to produce a desired output signal;

an energy store and an energy transfer mechanism, the energy store and the energy transfer mechanism being operable to allow the control circuit to control the timing and amount of any transfer of energy from the energy store;

a feedback circuit coupled to the upper power supply voltage plane and providing input to the control circuit; and a voltage inverting circuit coupled to the intermediate voltage plane and providing input to the control circuit.

2. The apparatus of claim 1, further including a light emitting diode operable to indicate proper operation of the apparatus.

3. The apparatus of claim 1, the control circuit being a pulse width modulator.

4. The apparatus of claim 1, the energy store being an inductor.

5. The apparatus of claim 1, the energy transfer mechanism being a diode and a switch controlled by the control circuit.

6. The apparatus of claim 5, the switch being a metal oxide semiconductor transistor.

7. The apparatus of claim 5, the switch being a bipolar transistor.

8. The apparatus of claim 1, the feedback circuit comprising a plurality of resistors arranged in a common voltage divider configuration.

9. The apparatus of claim 1, the voltage inverting circuit being a level voltage inverter circuit.

10. The apparatus of claim 1, the system being an emitter-coupled logic system.

11. The apparatus of claim 1, the system being a positive emitter-coupled logic system.

12. The apparatus of claim 1, the system being a current mode switching logic system.

13. An apparatus for regulating an intermediate voltage plane of a system relative to an upper power supply voltage plane, the apparatus comprising:

a control circuit operable to accept a plurality of input signals and to produce a desired output signal;

an energy supply and an energy transfer mechanism, the energy supply and the energy transfer mechanism being operable to allow the control circuit to control the timing and amount of any transfer of energy from the energy supply;

a feedback circuit coupled to the upper power supply voltage plane and providing input to the control circuit;

a voltage inverting circuit coupled to the intermediate voltage plane and providing input to the control circuit; and a light emitting diode operable to indicate proper operation of the apparatus.

14. The apparatus of claim 13, the control circuit being a pulse width modulator.

15. The apparatus of claim 13, the energy supply being external to the system.

16. The apparatus of claim 13, the energy supply being a battery.

17. The apparatus of claim 13, the energy transfer mechanism being a diode and a switch controlled by the control circuit.

18. The energy transfer mechanism of claim 17, the switch being a metal oxide semiconductor transistor.

19. The energy transfer mechanism of claim 17, the switch being a bipolar transistor.

20. The apparatus of claim 13, the feedback circuit comprising a plurality of resistors arranged in a common voltage divider configuration.

21. The apparatus of claim 13, the voltage inverting circuit being a level voltage inverter circuit.

22. The apparatus of claim 13, the system being an emitter-coupled logic system.

23. The apparatus of claim 13, the system being a positive emitter-coupled logic system.

24. The apparatus of claim 13, the system using current mode switching logic.

* * * * *